US009957969B2

(12) United States Patent
Krausche et al.

(10) Patent No.: US 9,957,969 B2
(45) Date of Patent: May 1, 2018

(54) DEVICE FOR CONTROLLING A GAS FLOW, AN EXHAUST AFTERTREATMENT SYSTEM AND A SYSTEM FOR PROPELLING A VEHICLE

(75) Inventors: Sebastian Krausche, Höllviken (SE); Lars Sundin, Malmö (SE)

(73) Assignee: Volvo Lastvagnar AB, Göteborg (SE)

( * ) Notice: Subject to any disclaimer, the term of this patent is extended or adjusted under 35 U.S.C. 154(b) by 640 days.

(21) Appl. No.: 14/402,205

(22) PCT Filed: Jun. 19, 2012

(86) PCT No.: PCT/EP2012/002580
§ 371 (c)(1),
(2), (4) Date: Nov. 19, 2014

(87) PCT Pub. No.: WO2013/189506
PCT Pub. Date: Dec. 27, 2013

(65) Prior Publication Data
US 2015/0167685 A1 Jun. 18, 2015

(51) Int. Cl.
*F01D 17/14* (2006.01)
*F04D 27/02* (2006.01)
(Continued)

(52) U.S. Cl.
CPC ..... *F04D 27/002* (2013.01); *F01D 17/165* (2013.01); *F02B 47/08* (2013.01);
(Continued)

(58) Field of Classification Search
CPC ..... F02C 9/20; F02C 9/22; F02D 2250/34; F01D 17/165; F01D 17/162;
(Continued)

(56) References Cited

U.S. PATENT DOCUMENTS 1,688,736 A * 10/1928 Moody ..... F03B 3/183 415/163
3,029,067 A * 4/1962 Parker ..... F01D 17/165 415/136

(Continued)

FOREIGN PATENT DOCUMENTS

CN 1433501 A 7/2003
CN 1650097 A 8/2005

(Continued)

OTHER PUBLICATIONS

Japanese Official Action dated Mar. 17, 2017 (translations) for corresponding Japanese App. 2016-108570.

(Continued)

*Primary Examiner* — Logan Kraft
*Assistant Examiner* — Joshua R Beebe
(74) *Attorney, Agent, or Firm* — WRB-IP LLP

(57) ABSTRACT

A device for controlling a gas flow through a passage includes a plurality of pivotable gas flow control vanes. The pivot axes of a first and a second adjacent vane are spaced so that a trailing edge of the first vane overlaps a leading edge of the second vane when the first and second adjacent vanes are positioned in a first mutual end state for substantially restricting the gas flow through the passage. The second vane includes a recess with such a shape that the trailing edge of the first vane is at least partly received in the recess when the first and second adjacent vanes are positioned in the first mutual end state.

19 Claims, 8 Drawing Sheets

(51) Int. Cl.

| | |
|---|---|
| ***F04D 27/00*** | (2006.01) |
| ***F01D 17/16*** | (2006.01) |
| ***F02B 47/08*** | (2006.01) |
| ***F04D 17/10*** | (2006.01) |

(52) U.S. Cl.
CPC ..... *F04D 17/10* (2013.01); *F05D 2220/40* (2013.01); *F05D 2240/121* (2013.01); *F05D 2250/70* (2013.01)

(58) Field of Classification Search
CPC ..... F01D 17/167; F01D 17/146; F01D 17/14; F01D 5/141; F01D 9/045; F01D 9/04; F01D 9/048; F01D 17/16; F05D 2240/121; F05D 2220/40; F05D 2250/70; F03B 3/183; F02B 37/24; F02B 27/06; F02B 47/08; F04D 17/10; F04D 27/002; F04D 27/00; F04D 27/02
See application file for complete search history.

(56) References Cited

U.S. PATENT DOCUMENTS

| | | | | |
|---|---|---|---|---|
| 3,286,983 | A * | 11/1966 | Scheper, Jr. | F01D 1/30 415/147 |
| 3,377,051 | A * | 4/1968 | Lecher | F03B 3/183 415/147 |
| 3,790,298 | A * | 2/1974 | Hendrickson | F01D 1/30 415/147 |
| 4,753,288 | A * | 6/1988 | Harvey | B60K 11/085 123/41.04 |
| 4,770,603 | A | 9/1988 | Engels et al. | |
| 4,856,962 | A | 8/1989 | McDow | |
| 5,518,365 | A | 5/1996 | Baets et al. | |
| 6,050,775 | A * | 4/2000 | Erdmann | F01D 17/165 384/138 |
| 7,150,151 | B2 * | 12/2006 | Mulloy | F01D 17/143 415/158 |
| 2003/0014972 | A1 | 1/2003 | Arnold | |
| 2003/0079474 | A1 * | 5/2003 | Finger | F01D 17/165 60/602 |
| 2005/0070491 | A1 | 3/2005 | Krieg et al. | |
| 2005/0220616 | A1 | 10/2005 | Vogiatzis et al. | |
| 2010/0098529 | A1 | 4/2010 | Roby et al. | |
| 2013/0017061 | A1 | 1/2013 | Roby et al. | |
| 2013/0213350 | A1 | 8/2013 | Watanabe et al. | |

FOREIGN PATENT DOCUMENTS

| | | | |
|---|---|---|---|
| CN | 101103178 | A | 1/2008 |
| CN | 101173614 | A | 5/2008 |
| CN | 201460998 | U | 5/2010 |
| CN | 201474730 | U | 5/2010 |
| DE | 102009006209 | A1 | 8/2010 |
| GB | 2413830 | A | 11/2005 |
| GB | 2467382 | A | 8/2010 |
| JP | S60028300 | | 2/1985 |
| JP | 6133933 | | 3/1986 |
| JP | S61112735 | A | 5/1986 |
| JP | H01158524 | | 11/1989 |
| JP | 2006183605 | | 7/2006 |
| JP | 2006183605 | A | 7/2006 |
| JP | 2008518147 | | 5/2008 |
| JP | 2010112223 | | 5/2010 |
| WO | 2008101105 | A2 | 8/2008 |

OTHER PUBLICATIONS

Japanese Official Action dated Oct. 5, 2016 for corresponding Japanese Appiicaton 2015-517613.
Chinese Official Action dated Jul. 15, 2015 from corresponding Chinese App. 201280074147.4.
Chinese Official Action dated Nov. 29, 2016 from corresponding Chinese App. 201280074147.4.
Japanese Official Action dated Nov. 27, 2015 (translation) for corresponding Japanese Application 2015-517613.
International Search Report dated Mar. 12, 2013 for corresponding International Application PCT/EP2012/002580.

* cited by examiner

DEVICE FOR CONTROLLING A GAS FLOW, AN EXHAUST AFTERTREATMENT SYSTEM AND A SYSTEM FOR PROPELLING A VEHICLE

BACKGROUND AND SUMMARY

The present invention relates to a device for controlling a gas flow and more specifically to a variable geometry turbine for a turbocharging unit for an internal combustion engine. The invention further relates to application of the device in an exhaust aftertreatment system for controlling the function of an exhaust aftertreatment unit in the exhaust aftertreatment system. One application is to achieve a high engine braking performance.

Turbochargers are well known and widely used with internal combustion engines for purpose of increasing power output, decreasing fuel consumption and emissions, and compensating for air density loss at high altitudes. Generally, turbochargers supply an increased charge air supply for the combustion process than can otherwise be induced through natural aspiration by utilizing exhaust gas energy to drive an air compressor. This increased air supply allows more fuel to be burned, thereby increasing power and output not otherwise obtainable from an engine having a given cylinder displacement under natural aspiration conditions.

Variable geometry turbochargers (VGTs) allow the intake airflow to be controlled and thereby optimized over a range of engine speeds. A VGT may for this purpose be provided with a plurality of inlet guide vanes on the turbine stator. An inlet passage to the turbine has a circumferential extension around the turbine and forms an annular passageway. The inlet guide vanes on the turbine stator are arranged circumferentially spaced in this passage. The intake airflow is optimized by changing the angle of the inlet guide vanes on the turbine stator. An optimal position for the inlet guide vanes is determined from a combination of desired torque response, fuel economy, and emission requirement.

More specifically, the annular passageway is connecting a scroll shaped volute defined in a turbine housing to a turbine chamber where the turbine is located. Each vane is connected to a vane pin housed in a nozzle ring. The vane pin is connected to a vane arm which connects the vane pin with a unison ring. Pivotal movement of the unison ring enables simultaneous pivoting of the vanes in the annular passageway. In order to control the end positions of the vanes, in particular when the vanes are set to delimit a narrow gap in between the tips of the vanes, a stop screw is used.

Further, in order to handle the strict emission regulations today, an exhaust aftertreatment system (EATS) comprising a diesel particulate filter (DPF) and a selective catalytic reduction (SCR) system is often used. When the engine is running at low load, the exhaust temperature isn't always high enough for this EATS to function with satisfaction since a certain temperature level is required for the chemical reactions. Hence, the exhaust temperature needs to be increased in order to achieve an acceptable performance from the EATS, so called heat mode or thermal management.

The type of VGT provided with inlet guide vanes as described above can be used in order to achieve an increased exhaust temperature in order to achieve an acceptable performance from the EATS. This is achieved by, in some operating points, closing the vanes to a "zero gap" position. Closing of the vanes may however result in damage to the vanes. The individual differencies in vane angle due to tolerances and the fact that the vanes should not be forced to close against each other due to stress and wear will make the leakage over the vanes, and hence boost, different for different individuals.

It is desirable to achieve a gas flow control device suitable for a turbo unit, which provides conditions for a robust control functionality.

According to a first aspect of the invention it is provided a device for controlling a gas flow through a passage, wherein the device comprises a plurality of pivotable gas flow control vanes, wherein the pivot axes of a first and a second adjacent vane are spaced so that a trailing edge of the first vane overlaps a leading edge of the second vane when said first and second adjacent vanes are positioned in a first mutual end state for substantially restricting said gas flow through said passage characterized in that the second vane comprises a recess with such a shape that the trailing edge of the first vane is at least partly received in the recess when said first and second adjacent vanes are positioned in said first mutual end state.

The design of the vanes creates conditions for achieving substantially the same leakage between two adjacent vanes when the vanes are in said first mutual end state (which represents a "closed" position) since the design allows for differencies in vane angle due to tolerances.

Further, by designing all vanes with such recesses, conditions are created for achieving a controlled leakage. More specifically, the leakage will be substantially the same over the complete extension of the vane arrangement, ie along the complete annular passageway in the turbocharger application providing for a robust and accurate control of the individual turbocharger unit.

Further, this solution creates conditions for that different individual turbo units will deliver substantially the same back pressure during operation in operating points with small gaps. Thus, the risk of different turbocharger units behaving differently is decreased.

According to a preferred embodiment, the first and second vanes are configured such that a surface of the trailing edge of the first vane facing the recess is positioned at a distance from an opposite surface of the recess when said first and second vanes are positioned in said first mutual end state. By defining an end state (representing a "closed" state) with a gap between the vanes, wear between the vanes during operation is reduced and thereby the life is increased. Preferably, the vanes are locked in this end state.

According to a further preferred embodiment, the recess of the second vane and the trailing edge of the first vane are configured for establishing a substantially constant gap between said opposite surfaces provided the vanes are within accepted tolerances when said first and second vanes are positioned in said first mutual end state. This design of the vanes will result in that substantially the same leakage between two adjacent vanes is achieved when the vanes are in said first mutual end state.

According to a second aspect of the invention it is provided an exhaust aftertreatment system for an internal combustion engine comprising at least one exhaust treatment device and a device according to above arranged upstream of the exhaust treatment device for achieving an elevated temperature in the exhaust gases by positioning said flow control vanes in said first mutual end state. Using the inventive device in the aftertreatment system creates conditions for achieving a robust performance from the EATS, a so called heat mode or thermal management.

According to a third aspect of the invention it is provided a system for propelling a vehicle comprising an internal combustion engine and a device according to above arranged in an exhaust line from the internal combustion engine for achieving a high exhaust back pressure when said flow control vanes are positioned in said first mutual end state. Using the inventive device in the propelling system creates conditions for achieving a robust performance with regard to engine braking.

BRIEF DESCRIPTION OF THE DRAWINGS

The present invention together with the above mentioned and other objects and advantages may best be understood from the following detailed description of the embodiments, but not restricted to the embodiments, wherein is shown schematically.

DETAILED DESCRIPTION

Figure 1:
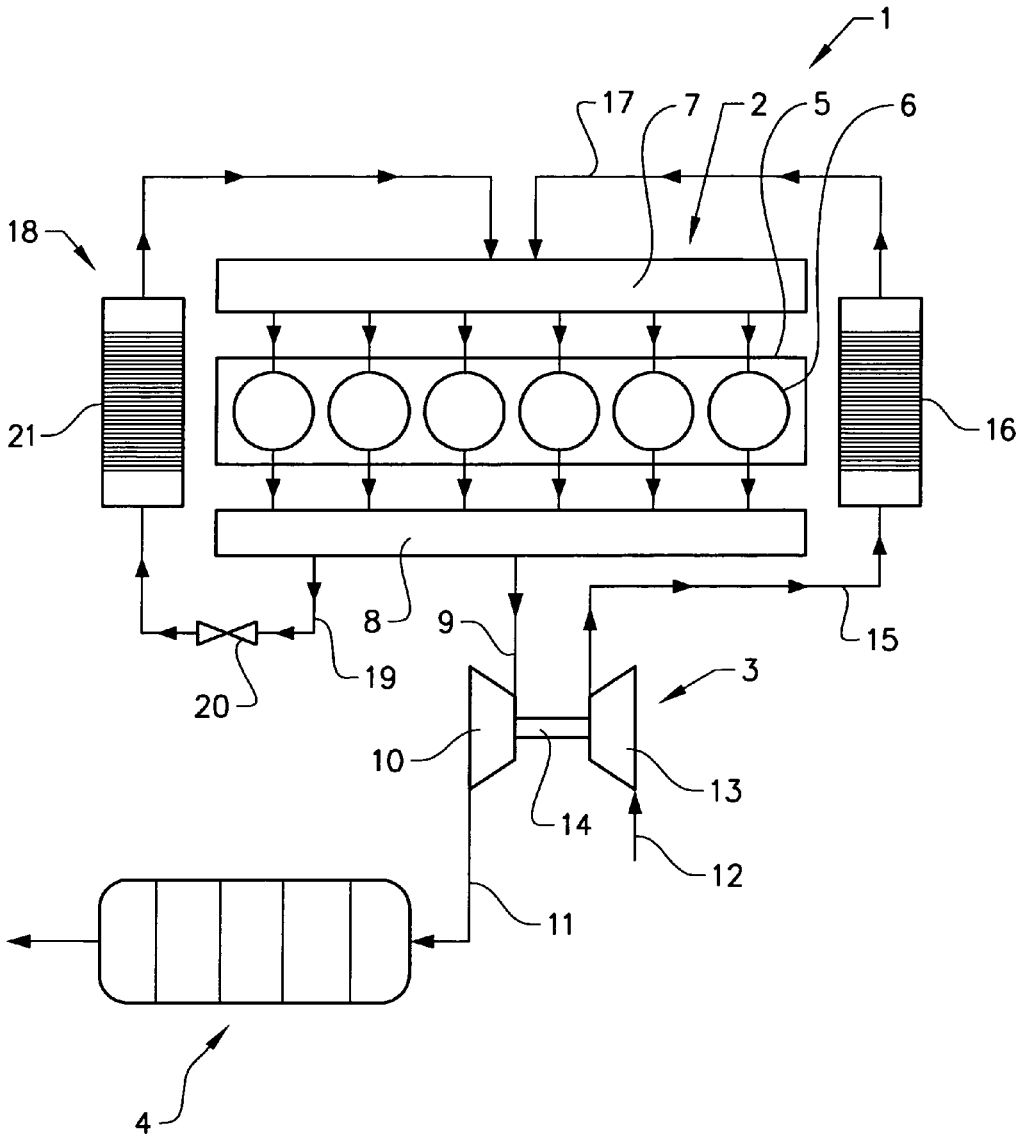
FIG. 1 Schematically shows a system for propelling a vehicle comprising an internal combustion engine, a turbocharger unit and a gas aftertreatment device.

FIG. 1 schematically shows a system 1 for propelling a vehicle, preferably a heavy-duty commercial vehicle such as a truck, bus or construction machine, comprising an internal combustion engine 2 in the form of a diesel engine, a turbocharger unit 3 and a gas aftertreatment device 4.

The engine comprises an engine block 5 with six cylinders 6 which communicate in a conventional manner with an inlet manifold 7 and an exhaust manifold 8. The exhaust manifold 8 receives exhaust gases from the engine cylinders. The exhaust gases are led through a pipe 9 (or turbine housing) from the exhaust manifold 8 to a turbine 10 in the turbocharger unit 3 and further via a pipe 11 from the turbine 10 to the gas aftertreatment device.

Filtered inlet air is admitted to the engine through a pipe 12 and led to a compressor 13 of the turbocharger unit 3. The compressor 13 is mounted on a common shaft 14 with the turbine 10. During operation, the compressor 13 is driven by the turbine 10.

Pipes 15, 17 lead the inlet air onward from the compressor 13 through a charge-air cooler 16 to the inlet manifold 7.

The system 1 further comprises an exhaust gas recirculation (EGR) arrangement 18, wherein part of the exhaust gases are lead from the exhaust manifold 8 via a pipe 19 back to the inlet manifold 7 via an EGR valve 20 and a cooler 21.

Figure 2:
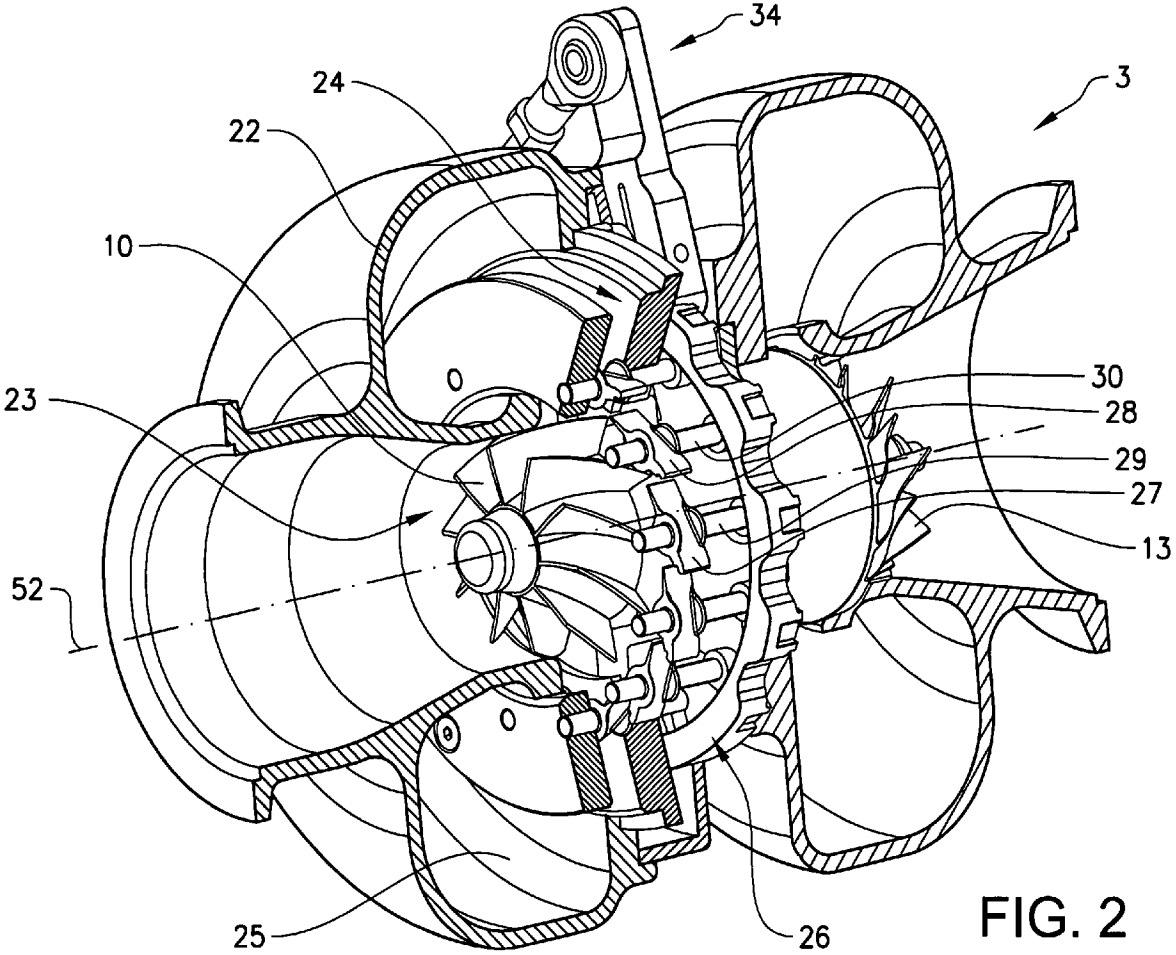
FIG. 2-3 shows two partly cut perspective views of a turbocharger unit in the system shown in FIG. 1 from two different directions.

FIG. 2 shows a partly cut perspective view of the turbocharger unit 3 from a first direction. The turbocharger unit 3 comprises a turbine housing 22 which defines a turbine chamber 23 where the turbine 10 is located. A passage 24 in the form of an annular passageway is formed in the turbine housing 22 and connects a scroll shaped volute 25 defined in the turbine housing 22 to the turbine chamber where the turbine 10 is located. In other words, said passage 24 forms a slot extending in a circumferential direction.

The turbocharger unit 3 comprises a device 26 for controlling a gas flow through the annular passageway passage 24 and thereby the flow of exhaust gas through the turbine 10. The device 26 comprises a plurality of pivotable gas flow control vanes 27,28. The pivot axes of said plurality of pivotable gas flow control vanes 27,28 are circumferentially spaced in the direction of said annular passageway 24. More specifically, each vane 27,28 is connected to a vane pin 29,30 housed in said turbine housing 22. The vane pins 29, 30 for all said vanes 27,28 are arranged in parallel with each other. Further, the vane pins 29,30 for said vanes 27,28 are arranged in parallel with an axial direction 52 of the common shaft 14. The pivotable gas flow control vanes 27,28 extends over substantially the complete width of the passage 24.

The gas flow control device 26 comprises a mechanism for setting said vanes 27,28 in unison in different pivotal positions.

In other words, the gas flow control device 26 comprises a rotor (the turbine 10), which is configured for receiving a gas from a radial direction, wherein the passage 24 is arranged upstream of the turbine 10 and wherein said plurality of pivotable gas flow control vanes 27,28 are formed by inlet guide vanes arranged around the rotor. More specifically, said plurality of pivotable gas flow control vanes 27,28 is arranged directly upstream of the turbine 10. Further, said turbine 10 is configured to rotate around a rotational axis 52 and the flow control vanes 27,28 are arranged so that said pivot axes are in parallel with the rotational axis 52 of the turbine 10. Thus, said turbine forms a variable geometry turbine.

Figure 3:
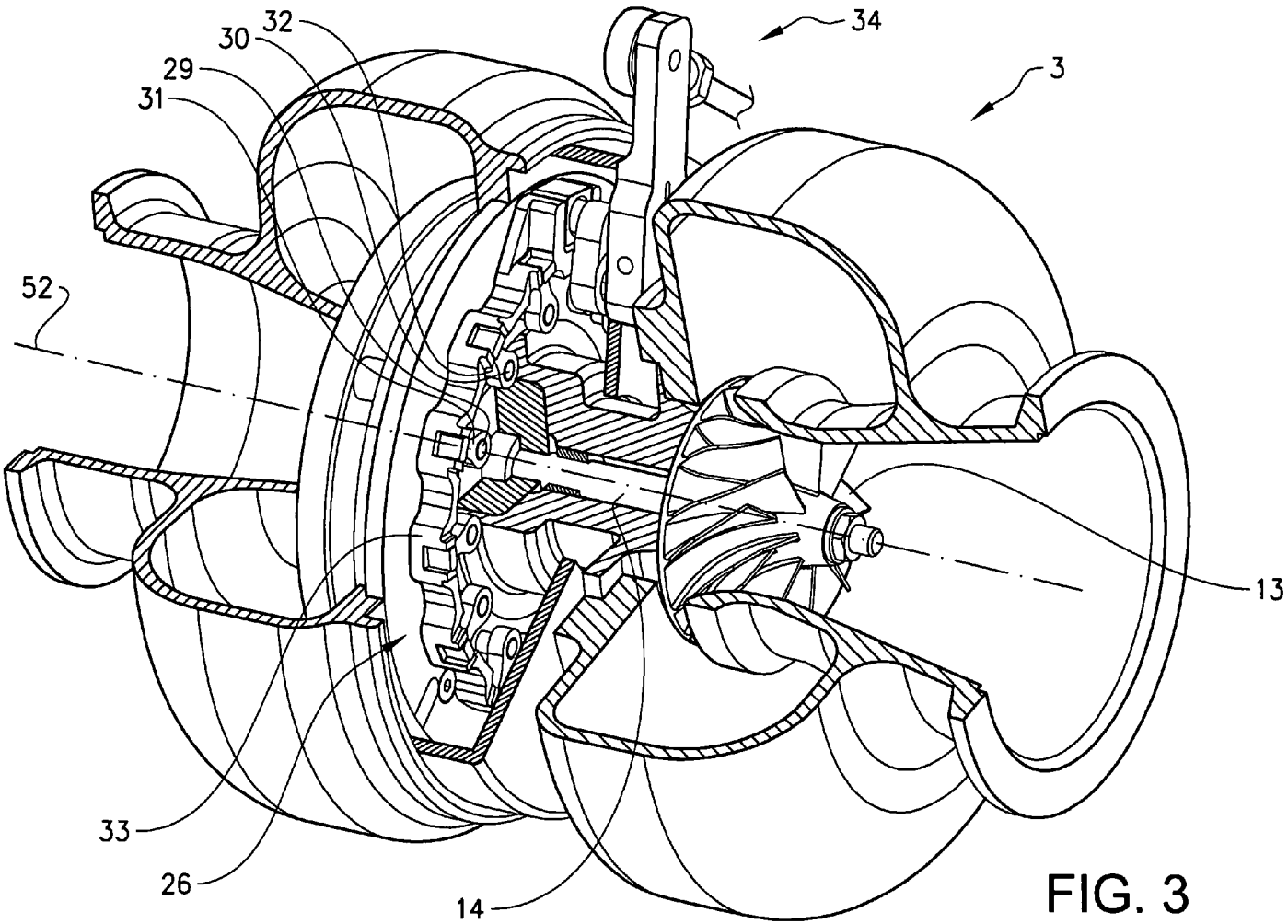

FIG. 3 shows a partly cut perspective view of the turbocharger unit 3 from a second direction. More specifically, the device 26 for controlling a gas flow through the annular passageway 24 is shown from the other side in relation to FIG. 2. Each vane pin 29, 30 is connected to a vane arm 31,32 which connects the vane pin with a unison control ring 33. Pivotal movement of the unison ring 33 enables simultaneous pivoting of the vanes 27,28 in the annular passageway 24. The unison ring 33 is pivotally arranged in a trace formed in the turbine housing 22 or a flange member attached to the turbine housing. In order to accomplish the pivoting movement of the unison ring 33, a mechanism 34 for setting said vanes in unison in different pivotal positions is provided.

Figure 4:
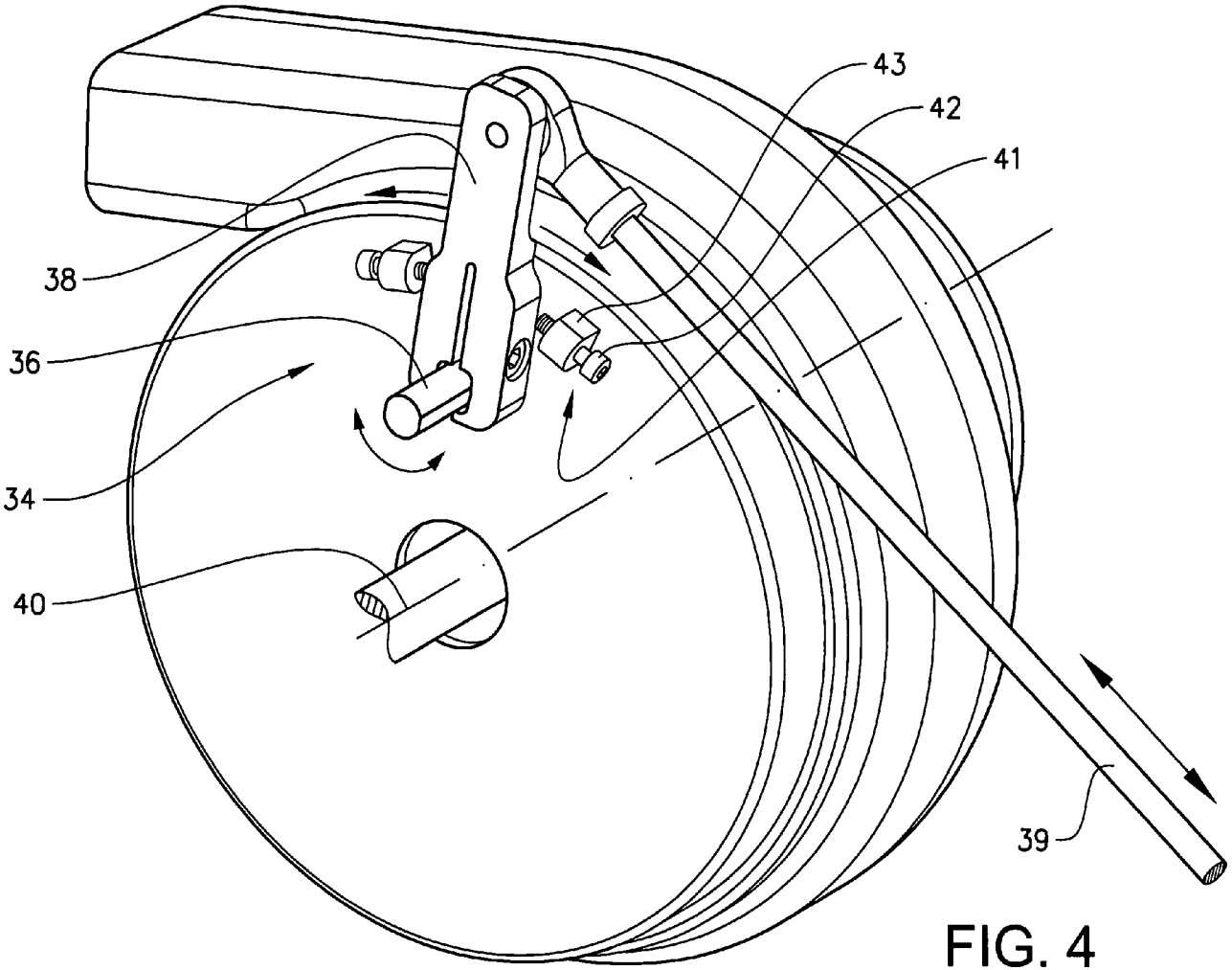
FIG. 4-5 shows a mechanism for controlling angular position of the vanes in a gas flow control device for controlling inlet gas to a turbine in the turbocharger unit shown in FIG. 2-3.
Figure 5:
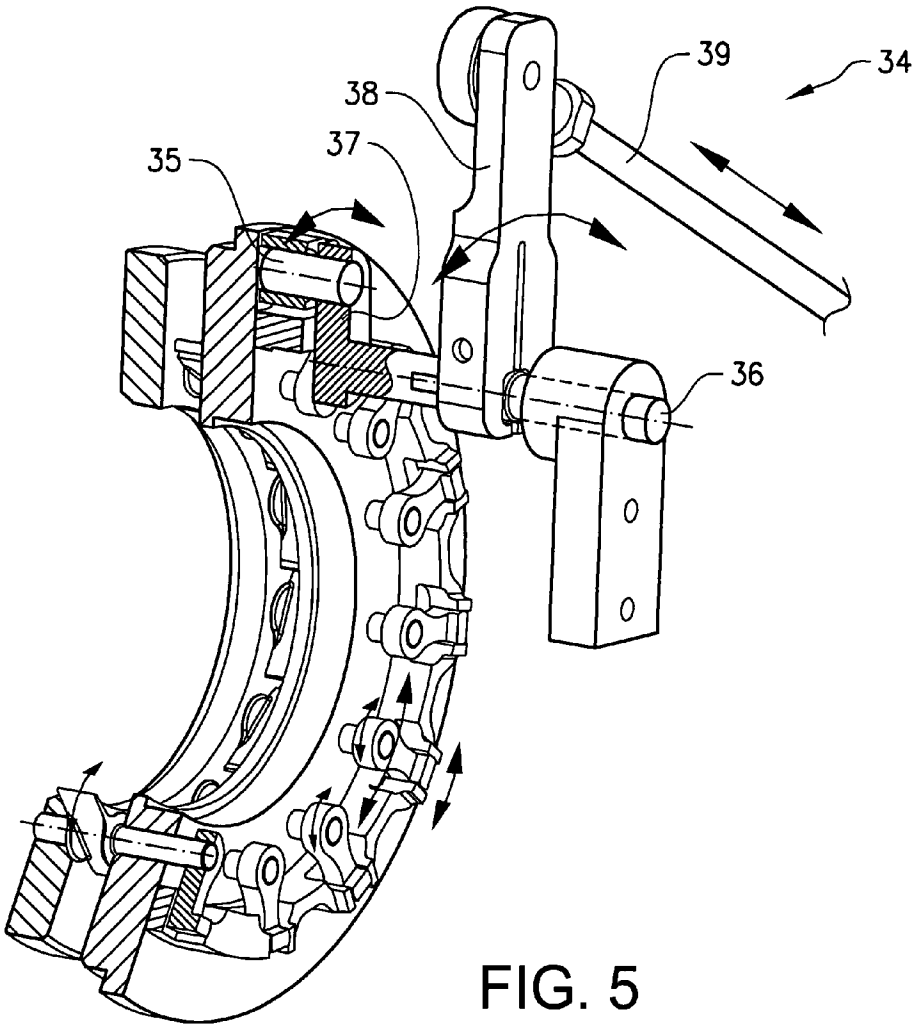

FIG. 4-5 shows the displacement mechanism 34 in more detail. The displacement mechanism 34 comprises a unison ring. The arrows indicate pivoting and linear movements, respectively. The unison ring displacement mechanism 34 comprises a pivot axle 35 housed in said turbine housing 22, a pivotably arranged pin 36 engaged with the unison ring 33 at a radial distance from the pivot axle 35 and an actuator arm 37 operatively connected to said pivot axle 35 and the pin 36.

The unison ring displacement mechanism 34 further comprises a second actuator arm 38 arranged on said pin 36, which second arm is connected to an actuator via a push rod 39. Using an actuator to act on the second actuator arm 38 turns the pin 36 and thereby the first actuator arm, which in turn pivots about the pivot axle 35. This unison ring displacement mechanism 34 enables pivoting of the unison ring 33 around its rotational axis 40.

The unison ring displacement mechanism 34 further comprises a means 41 for limiting angular movement of the vanes 27,28. Said angular movement limiting means 41 comprises a manually operable stop screw 42, which is arranged for limiting the displacement of a member in said unison ring displacement mechanism 34. In the embodiment shown in FIG. 4, the stop screw 42 is arranged to act on the actuator arm 38. The stop screw 42 is arranged on a seating 43 integrally formed in the turbine housing 22.

Figure 6:
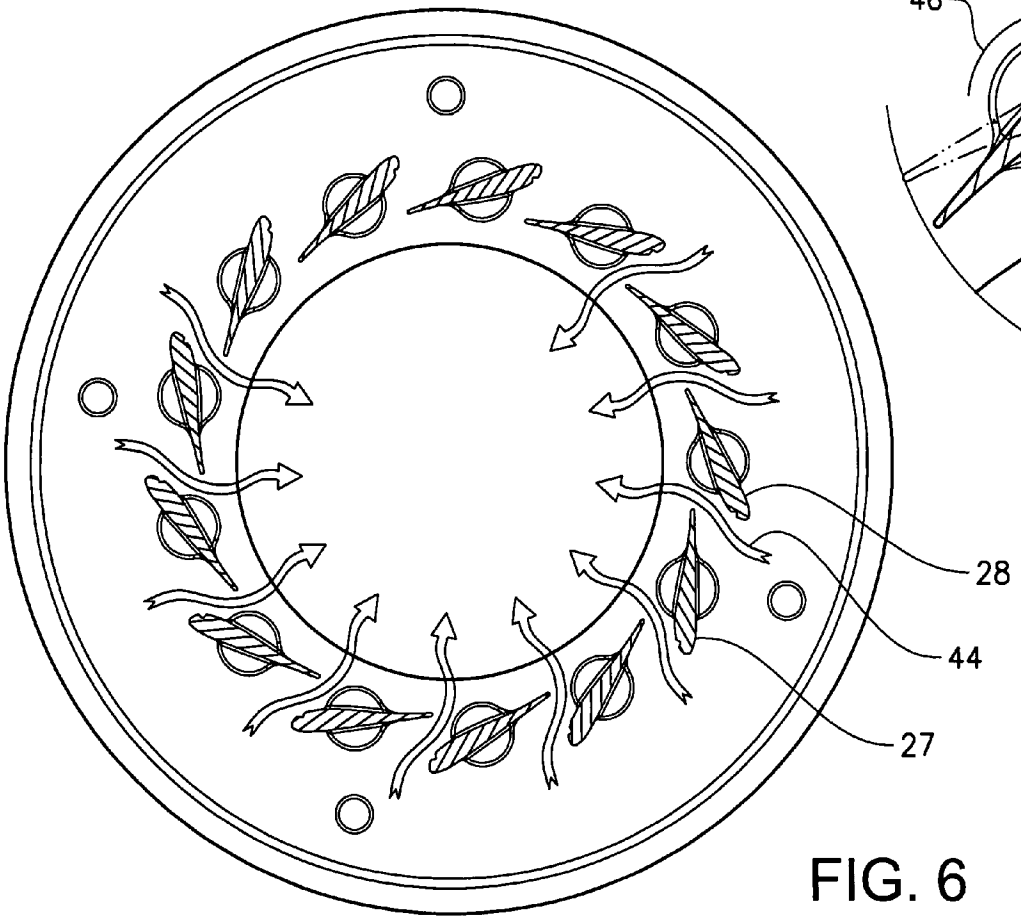

FIG. 6 shows the plurality of pivotable gas flow control vanes 27, 28 in a cut view from the side. The pivot axes of the pivotable gas flow control vanes 27,28 are arranged equidistant in the circumferential direction of the annular passageway 24. The pivotable gas flow control vanes 27, 28 are in FIG. 6 shown in an open state, in which gas flow 44 is allowed to pass in a substantially unrestricted manner. More specifically, a trailing edge of the first vane 27 is positioned at a substantial distance from a leading edge of the second vane 28 when said first and second adjacent vanes 27,28 are positioned in a second mutual end state (representing an "open state") for allowing said gas flow through said passage.

Figure 8:
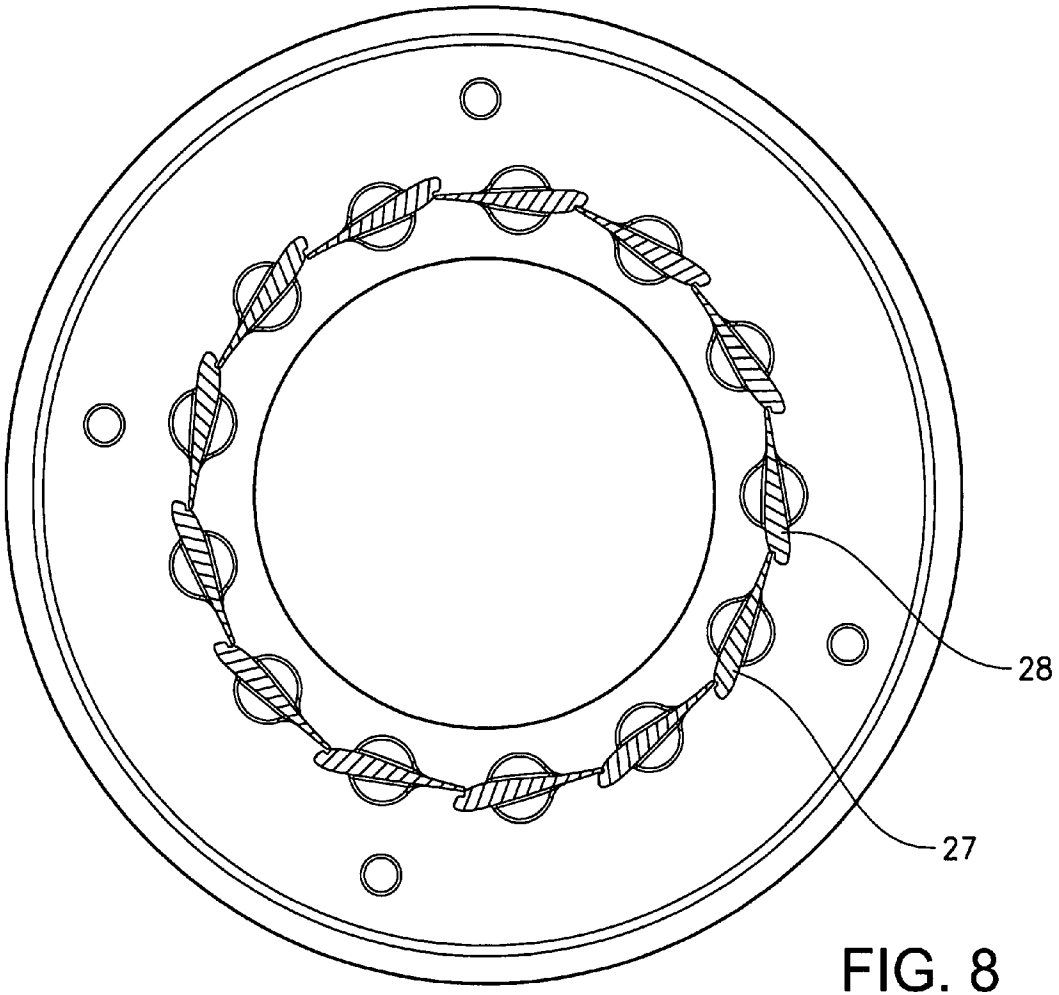

FIG. 8 shows the pivotable gas flow control vanes 27,28 in the same view as FIG. 6, with the difference that the vanes are arranged in a first mutual end state (representing a "closed state").

Figure 7:
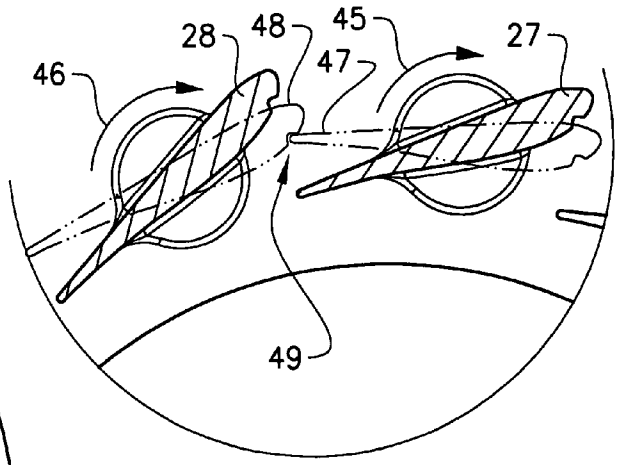
FIG. 6-9 shows different angular positions of the vanes in a gas flow control device in FIG. 4-5.

FIG. 7 shows a first and second adjacent vane 27,28 in an enlarged view. The arrows 45,46 indicate the pivotal movement of the vanes 27,28 between the first mutual end state for substantially restricting said gas flow through said passage ("closed state"), see dotted marking, and the second mutual end state ("open state"). The pivot axes of the first and a second adjacent vanes 27,28 are spaced so that a trailing edge 47 of the first vane 27 overlaps a leading edge 48 of the second vane 28 when said first and second adjacent vanes are positioned in said first mutual end state.

Figures 9, 10, 11:
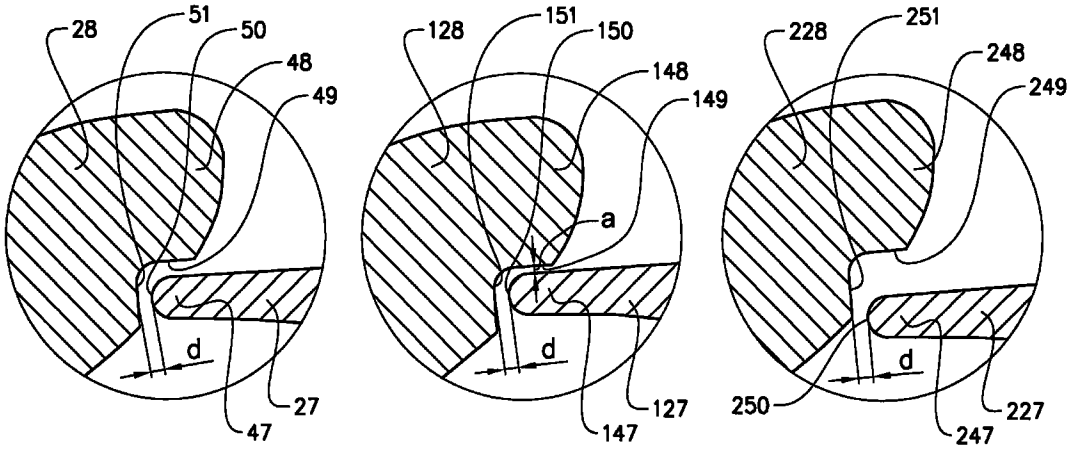
FIG. 10-11 shows two other individual gas flow control devices.

FIGS. 9-11 show three different individual gas flow control devices, wherein the difference between the three figures is that the mutual position of the adjacent vanes 27,28 differs within accepted tolerances.

FIG. 9 shows the design of the trailing edge 47 of the first vane 27 overlapping the leading edge 48 of the second vane 28. The second vane 28 comprises a recess, or notch 49 with such a shape that the trailing edge 47 of the first vane 27 is at least partly received in the recess 49 when said first and second adjacent vanes 27,28 are positioned in said first mutual end state.

FIGS. 9-11 shows that the recess 49,149,249 of the second vane 28,128,228 and the trailing edge 47,147,247 of the first vane 27, 127, 227 are configured for establishing a substantially constant gap d between a surface 50,150,250 of the trailing edge 47,147,247 of the first vane 27,127,227 facing the recess 49,149,249 and an opposite surface 51,151,251 of the recess 49,149,249 provided the vanes are within accepted tolerances when said first and second vanes 27, 127, 227; 28, 128, 228 are positioned in said first mutual end state.

FIG. 10 further shows that the first and second vanes 127, 128 are configured such that a surface 150 of the trailing edge 147 of the first vane 127 facing the recess 149 is positioned at a distance a from an opposite surface 151 of the recess 149 when said first and second vanes 127,128 are positioned in said first mutual end state.

Referring now also to FIG. 4, said angular movement limiting means 41 is adapted to limit the distance between the vanes 127,128 to not exceed the predetermined distance a. In this way, wear during operation between the facing surfaces of the adjacent vanes will be limited.

Referring again to the embodiment of FIGS. 1-9, the pivot axes of all vanes 27,28 in said plurality of vanes are circumferentially spaced so that a trailing edge of each of said vanes overlaps a leading edge of an adjacent vane when said vanes are positioned in the first mutual end state. Further, each of said vanes 27,28 comprises a recess 49 with such a shape that the trailing edge of an adjacent vane is at least partly received in the recess when said vanes are positioned in said first mutual end state.

Each of said vanes 27, 28 has the shape of an airfoil in cross section. Each of said vanes 27,28 may have a pressure side and a suction side extending between the leading edge and the trailing edge, wherein the recess 49 is provided on the pressure side. The terms "pressure side" and "suction side" are conventional definitions regarding airfoil vane geometry. It should be noted that in extreme operating points, the defined pressure side may in fact rather operate with a suction function and vice versa.

Said recess 49 is provided in the vicinity of the leading edge. Said recess 49 has an elongated shape extending in a transverse direction with regard to a chord line between the leading edge and the trailing edge. Further, said recess 49 extends over the complete width of the vane. Further, said recess has a constant width over a distance corresponding to the width of the trailing edge of the first vane. Further, the shape of the trailing edge of the first vane and the recess of the second vane are configured for matching each other. Preferably, said recess has a constant width over the complete width of the first vane.

A depth of the recess 49 is preferably below 2 mm and especially below 1.5 mm for the application of the device in a turbocharger unit for an internal combustion engine. Further, the depth of the recess is preferably above 0.2 mm for said application.

A mean camber line is defined as the locus of points halfway between the side surfaces of the vane as measured perpendicular to the mean camber line itself. The vane has a cambered shape, ie it is asymmetric. The mean camber line in this case follows a curved line between the leading edge and the trailing edge.

According to a further development, a surface of the recess facing the trailing edge of the first vane has a curvature corresponding to a turning angle of the first vane for establishing a substantially constant gap between the trailing edge of the first vane and a surface of the recess provided the vanes are within accepted tolerances when said first and second vanes are positioned in said first mutual end state.

The invention must not be regarded as being limited to the examples of embodiment described above, a number of further variants and modifications being feasible without departing from the scope of the following claims.

The invention claimed is:

1. A device for controlling a gas flow through a passage, wherein the device comprises a plurality of pivotable gas flow control vanes, wherein the pivot axes of a first and a second adjacent vane are spaced so that a trailing edge of the first vane overlaps a leading edge of the second vane when the first and second adjacent vanes are positioned in a first mutual end state for substantially restricting the gas flow through the passage, wherein the second vane comprises a recess with such a shape that the trailing edge of the first vane is at least partly received in the recess when the first and second adjacent varies are positioned in the first mutual end state, wherein the ress of the second vane and the trailing edge of the first vane are configured for establishing a substantially constant, non-zero gap between opposite facing surfaces of the vanes when the first and second vanes are positioned in the first mutual end state, such that there is no contact between the recess of the second vane and the trailing edge of the first vane in the first mutual end state.

2. A device according to claim 1, wherein the first and second vanes are configured such that a surface of the trailing edge of the first vane facing the recess is positioned at a distance from an opposite surface of the recess when the first and second vanes are positioned, in the first mutual end state.

3. A device according to claim 1, wherein the passage forms a slot extending in a circumferential direction and that the pivot axes of the first and second pivotable gas flow control vanes are circumferentially spaced in the circumferential direction.

4. A device according to claim 1, wherein the passage forms a slot extending in a circumferential direction and that the pivot axes of all vanes in the plurality of vanes are circumferentially spaced so that a trailing edge of each of the vanes overlaps a leading edge of an adjacent vane when the vanes are positioned in the first mutual end state and that each of the vanes comprises a recess with such a shape that the trailing edge of an adjacent vane is received in the recess when the vanes are positioned in the first mutual end state.

5. A device according to claim 1, wherein each of the vanes has the shape of an airfoil in cross section.

6. A device according to claim 1, wherein the recess is provided in the vicinity of the leading edge.

7. A device according to claim 1, wherein the recess has an elongated shape extending in a transverse direction with regard to a chord line between the leading edge and the trailing edge.

8. A device according to claim 7, wherein the recess extends over the complete width of the second vane.

9. A device according to claim 1, wherein the device comprises a mechanism for setting the vanes in unison in different pivotal positions.

10. A device according to claim 1, wherein the device comprises rotor, which is configured for receiving a gas from a radial direction, that the passage is arranged upstream of the rotor and that the plurality of pivotable gas flow control vanes are formed by inlet guide vanes arranged around the rotor.

11. A device according to claim 10, wherein the plurality of pivotable gas flow control vanes is arranged directly upstream of the rotor.

12. A device according to claim 10, wherein the rotor is configured to rotate around a rotational axis and that the flow control vanes are arranged so that the pivot axes are in parallel with the rotational axis of the rotor.

13. A device according to claim 1, wherein the device is configured for a variable geometry of a turbine for a turbocharging unit for an internal combustion engine.

14. A device according to claim 1, wherein a depth of the recess is below 2 mm.

15. A device according to claim 1, a depth of the recess is above 0.2 mm.

16. A device according to claim 1, wherein a trailing edge of the first vane is positioned at a substantial distance from a leading edge of the second vane when the first and second adjacent vanes are positioned in a second mutual end state for allowing the gas flow through the passage.

17. An exhaust aftertreatment system for an internal combustion engine comprising at least one exhaust treatment device and a gas flow control device according to claim 1 arranged upstream of the exhaust treatment device for achieving an elevated temperature in the exhaust gases by positioning the flow control vanes in the first mutual end state.

18. A system for propelling a vehicle comprising an internal combustion engine and a gas flow control device according to claim 1 arranged in an exhaust line from the internal combustion engine for achieving a high exhaust back pressure when the flow control vanes are positioned in the first mutual end state.

19. A system according to claim 18, wherein the gas flow control device is configured for achieving engine braking when the flow control vanes are positioned in the first mutual end state.

* * * * *